US009527626B1

(12) United States Patent
Coronado

(10) Patent No.: US 9,527,626 B1
(45) Date of Patent: Dec. 27, 2016

(54) POP UP CARGO TOTE

(71) Applicant: The Gem Group, Inc., Lawrence, MA (US)

(72) Inventor: Sergio Coronado, Medford, MA (US)

(73) Assignee: The Gem Group, Inc., Lawrence, MA (US)

( * ) Notice: Subject to any disclaimer, the term of this patent is extended or adjusted under 35 U.S.C. 154(b) by 16 days.

(21) Appl. No.: 14/728,487

(22) Filed: Jun. 2, 2015

Related U.S. Application Data

(60) Provisional application No. 62/009,062, filed on Jun. 6, 2014.

(51) Int. Cl.

| | |
|---|---|
| ***B65D 6/00*** | (2006.01) |
| ***B65D 21/08*** | (2006.01) |
| ***B65D 25/04*** | (2006.01) |
| ***B65D 25/30*** | (2006.01) |
| *B65D 6/18* | (2006.01) |
| *A45C 7/00* | (2006.01) |
| *A45C 3/04* | (2006.01) |

(52) U.S. Cl.
CPC ..... *B65D 21/086* (2013.01); *B65D 25/04* (2013.01); *B65D 25/30* (2013.01); *A45C 3/04* (2013.01); *A45C 7/0077* (2013.01); *B65D 11/1846* (2013.01)

(58) Field of Classification Search
CPC ..... B65D 21/086; B65D 11/1846; B65D 5/36; B65D 11/1833; B65D 11/1853; B65D 2501/2421; B65D 5/48; A45C 7/0036; A45C 3/04; A45C 7/0077; A45C 13/02; A45C 7/0022; A45C 7/0054; A45C 9/00; D06F 95/002; Y10S 224/925
USPC ..... 220/7
See application file for complete search history.

(56) References Cited

U.S. PATENT DOCUMENTS

| | | | | |
|---|---|---|---|---|
| 2,925,933 | A * | 2/1960 | Watson | B65D 11/188 220/573.1 |
| 3,338,503 | A * | 8/1967 | Bruce Beh | B65D 5/0035 229/117.17 |
| 3,800,990 | A | 4/1974 | Richardson | |
| 4,576,329 | A * | 3/1986 | Wright | B65D 5/46024 190/107 |

(Continued)

FOREIGN PATENT DOCUMENTS

EP 1505001 A1 2/2005

*Primary Examiner* — Shawn M Braden
(74) *Attorney, Agent, or Firm* — Loginov & Associates, PLLC; William A. Loginov

(57) ABSTRACT

A collapsible cargo tote is comprised of a bottom with an integral stiffener plate, at least one unitary end wall with an integral stiffener plate hingedly attached to the bottom a center wall and a sidewall, at least one sidewall comprised of three triangular panels, each having a stiffener panel, a center wall comprised of a locking cuff and three triangular panels, each with an integral stiffener panel and an exterior surface covering hingedly attached to each other. The sidewall, end wall and center wall collapse when the locking cuff is unlocked into a collapsed configuration and transitions from a collapsed configuration to an erect configuration when an end wall is raised and the sidewalls, end wall and center wall are raised into a vertical configuration. The locking cuff holds the tote in an erect configuration by the engagement of the locking cuff with the panels of the center wall.

7 Claims, 7 Drawing Sheets

(56) References Cited

U.S. PATENT DOCUMENTS 5,024,344 A * 6/1991 Paula ..... A45C 7/0077 220/9.3
5,086,888 A * 2/1992 Chu ..... A45C 7/0036 190/107
6,015,071 A * 1/2000 Adomeit ..... B60R 7/02 220/6
6,056,177 A * 5/2000 Schneider ..... B60R 5/04 220/4.28
6,065,873 A * 5/2000 Fowler ..... A45C 3/04 383/10
6,206,224 B1 * 3/2001 Potts ..... B62B 3/1464 220/23.86
6,234,677 B1 * 5/2001 Mogil ..... A45C 7/0077 206/545
6,817,504 B2 * 11/2004 Drane ..... B60R 7/02 220/6
7,028,834 B2 * 4/2006 Karpel ..... A45C 7/0036 206/38.1
7,624,886 B2 * 12/2009 Huang ..... A45C 5/045 220/507
7,845,508 B2 * 12/2010 Rothschild ..... A45C 7/0054 190/107
8,424,829 B2 * 4/2013 Lu ..... A45C 7/0036 248/152
8,459,489 B2 * 6/2013 Potts ..... A45C 7/0022 220/212
8,474,640 B2 * 7/2013 Armstrong ..... A45C 7/0081 206/581
8,727,172 B2 * 5/2014 Burgess ..... D06F 95/002 220/532
8,978,850 B2 * 3/2015 Bettua ..... A45C 7/0068 190/103
8,985,432 B2 * 3/2015 Cullen ..... B65D 11/1853 206/170
9,016,494 B1 * 4/2015 Hernandez ..... B65D 25/2805 190/107
2005/0034948 A1 * 2/2005 Tiramani ..... A45C 7/0036 190/107
2005/0230390 A1 * 10/2005 Glenn ..... D06F 95/002 220/6
2007/0034626 A1 * 2/2007 Warren ..... A45C 7/0036 220/9.2
2008/0083629 A1 * 4/2008 Soucie ..... A45C 3/04 206/170
2009/0032348 A1 * 2/2009 Wang ..... B65D 31/12 190/103
2009/0148076 A1 * 6/2009 Chang ..... B65D 21/086 383/22
2012/0018330 A1 * 1/2012 Kato ..... A45C 7/0036 206/372
2015/0083764 A1 * 3/2015 Houston ..... A45C 9/00 224/156
2015/0125096 A1 * 5/2015 Mulholland ..... B65D 31/02 383/38

* cited by examiner

POP UP CARGO TOTE

RELATED APPLICATION

This application claims the benefit of U.S. Provisional Application Ser. No. 62/009,062, filed Jun. 6, 2014, entitled POP UP CARGO TOTE, the entire disclosure of which is herein incorporated by reference.

FIELD OF THE INVENTION

This invention is in the field of containers, and more particularly, to containers that can be collapsed or folded.

BACKGROUND OF THE INVENTION

Containers that can retain and hold items such as food, toys, beverages, ice and the like are a part of modern life. Portable containers can have lids that are removable, slideable or hinged, or not have a lid at all. Containers are found in the home, in vehicles, vessels and outside, at the camp site. Portable containers are handy and allow movement of the container and the contained items. One disadvantage of containers is that after the items have been removed, the container continues to occupy its volume. In places where interior volume is precious, for example, in a car, on a boat or in a camper, the container can be taking up space that could be used for other activities and/or things. Furthermore, an empty container, while lighter than when it was filled, is bulky to move. Collapsible containers are containers that can be collapsed to a smaller volume for ease of storage, ease of movement and space-saving. But many collapsible containers require a series of steps and movements to effect the collapse. Moreover, some collapsible containers can require using both hands to collapse. Many collapsible containers are, by their nature, too lightly built or rigid for ease of collapse. It would be desirable to provide a container that is has the necessary and appropriate sturdiness to provides a storage bin with a good retention of filled items, while collapse can be effected with a single hand in a minimum of movement, resulting in a collapsed container of minimum size that can be readily stored and/or transported, and is readily re-deployed as a container.

SUMMARY OF THE INVENTION

The present invention overcomes the disadvantages of the prior art by providing a collapsible container that provides a cargo tote that is easy to erect and easy to collapse. The collapsible cargo tote is comprised of a unitary bottom with an integral stiffener plate and an exterior surface covering, at least one unitary end wall with an integral stiffener plate and an exterior surface covering hingedly attached to the bottom and to a sidewall, at least one sidewall comprised of three triangular panels, each with an integral stiffener panel and an exterior surface covering hingedly attached to each other including diagonal seam lines that are hingedly attached to an end wall, a center wall and a bottom, a center wall comprised of a locking cuff and three triangular panels, each with an integral stiffener panel and an exterior surface covering hingedly attached to each other including diagonal seam lines that are hingedly attached to an end wall, a center wall and a bottom. The sidewall, end wall and center wall are constructed and arranged to collapse when the locking cuff is unlocked, causing the cargo tote to collapse completely into a collapsed configuration and to transition from a collapsed configuration to an erect configuration when an end wall is raised and the sidewalls, end wall and center wall are raised into a vertical configuration. The locking cuff holds the tote in an erect configuration by the engagement of the locking cuff with the panels of the center wall. At least one of the end walls is constructed and arranged with cutouts that are handles. The locking cuff is provided with a hook and loop closure mechanism. In further embodiments, this can be a snap closure or a magnetic closure mechanism. The sidewalls and at least one of the end walls defines an interior volume for the containment of at least one item of goods when in the erect configuration.

BRIEF DESCRIPTION OF THE DRAWINGS

The invention description below refers to the accompanying drawings, of which.

DETAILED DESCRIPTION

Figure 1:
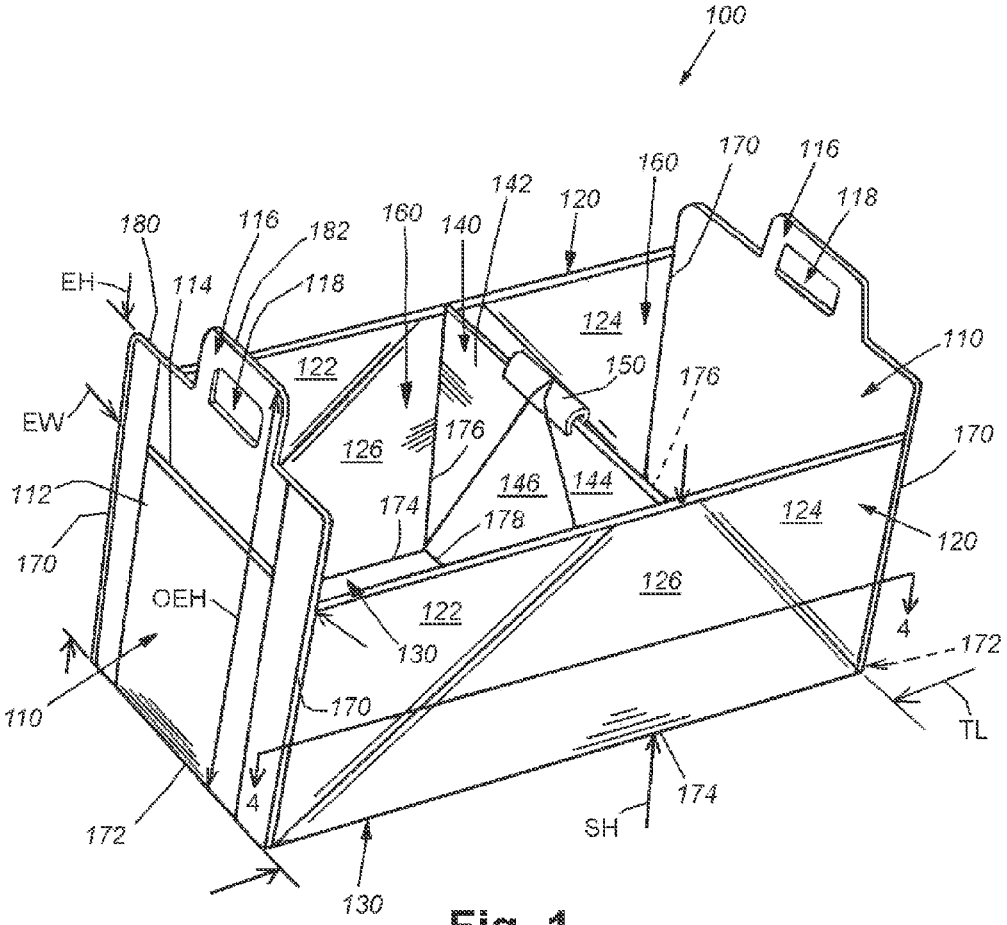
FIG. 1 is a perspective view of a collapsible cargo tote in an erect configuration according to the illustrative embodiment.

An illustrative collapsible cargo tote 100 is provided with a pair of opposing end walls 110, a pair of opposing side walls 120, a bottom wall 130 and a center wall 140 according to an illustrative embodiment. The end walls 110 can each comprise a single unitary panel. At least one of the end walls 110 is provided with a pocket 112 with a top opening 114 for storage of various articles. Each end wall 110 is provided with a handle 116 that defines a cutout 118 for receiving the hand and/or fingers of the person carrying the tote. The side walls 120 are each comprised of three interconnected panel sections, a first panel section 122, a second panel section 124 that is a mirror image of the first panel 122 and a third panel 126. As will be described more fully below, each panel is provided with a respective discrete internal stiffener panel that is sandwiched between the material that comprises the outer surface covering of the side walls 120.

The center wall 140 is comprised of three panels, a first panel 142, a counterpoised second panel 144 and a third panel 146. The center wall panels 142-146 can be hingedly connected to one another to create the overall center wall 140. A locking cuff 150 is located at the top center of the center wall 140. In the embodiment of FIG. 1, the locking cuff 150 is depicted as sewn on to the center wall. In other examples, the locking cuff can be attached to the center wall 140 by any other attachment method or device, such as rivets, snaps, adhesives, or another mechanism.

The collapsible cargo tote 100 has two configurations or states. In an erect configuration, as depicted in FIG. 1, the tote 100 is a semi rigid structure that is held in place by the locking cuff 150, as will be more fully described below. When the tote 100 is in the erect configuration, two adjoining cargo bins 160 are defined by the space between the end walls 110 and the side walls 120 with a closed bottom and an open top, with the center wall 140 dividing the space into the two adjoining cargo bins. The second configuration is the collapsed configuration that is defined as lying relatively flat, without cargo bins 160. In the collapsed configuration, the end walls, side walls and center wall collapse so that the end walls are at the top, the sidewalls are under the end walls, the bottom remains at the bottom and the center wall is sandwiched between the bottom and the sidewalls.

The collapsible cargo tote 100 is constructed so that each of the walls and panels has an internal stiffener panel and outer surface coverings. The outer surface is unitary along each of the end walls 110, side walls 120, bottom 130 and center wall 140. Each of the end walls 110 is connected to adjoining panels at seams. Side seams 170 connect the end walls 110 to side walls 120. Bottom end seams 172 connect the respective end walls 110 and the bottom 130. Bottom side seams 174 connect the side walls 120 to the bottom 130. The center wall 130 is connected to the side walls 120 at the center side seams 176 and to the bottom at the center bottom seam 178. Each of the seams is a hinge that provides for movement of the panels within a limited range that does not exceed ninety (90) degrees. This limitation is imposed by the interconnected structures of the end walls 110, sidewalls 120, bottom 130 and center wall 140 and prevents hyperextension of the seams and distortion of the collapsible tote 100. The seams can be created by linear stitching across the outer surface along the spaces between the stiffeners, by pleating, reinforcements or other sewing techniques.

In the erect configuration, the tote 100 has an overall length TL of approximately twenty-four inches (60 cm) between the vertical side seams 170. The sidewalls 120 have a height SH of approximately 12 inches (30 cm) from the bottom side seam 174 to the top of the side wall 120. The end walls 110 have a variable height. The first height EH from the bottom end seam 172 to a first top surface 182 is approximately 14 inches (35 cm). A second height OEH describes the distance from the bottom end seam 172 to a second top surface 182 that is at the top of the handle 116 as approximately 17 inches (43 cm). The width of the end wall EW is approximately 12 inches (30 cm). The enclosed volume of the illustrative tote 100 in the erect state is approximately 2 cubic feet (56.6 liters) and each bin therefore describes a volume of approximately one cubic foot (28.3 liters). It is expressly contemplated that these dimensions can be greater or lesser depending on the desires of the consuming public and that totes having larger dimensions that are longer and wider can be fabricated in accordance with the invention as described herein.

The tote 100 is a container that can be placed into an erect configuration to create a partially enclosed internal volume for storage that is open on the top and is collapsible to a collapsed configuration that lacks an internal volume space for storage. As such the collapsible tote 100 can be used with connection with vehicles, vessels, aircraft, in the home, office or other setting. The sidewalls and at least one of the end walls defines an interior volume for the containment of at least one item of goods when in the erect configuration. The goods that can be placed into this interior volume of space can be groceries, car maintenance items, laundry of any other singular or collective assembly of goods suitable by volumetric displacement for placing into the cargo tote.

Figure 2:
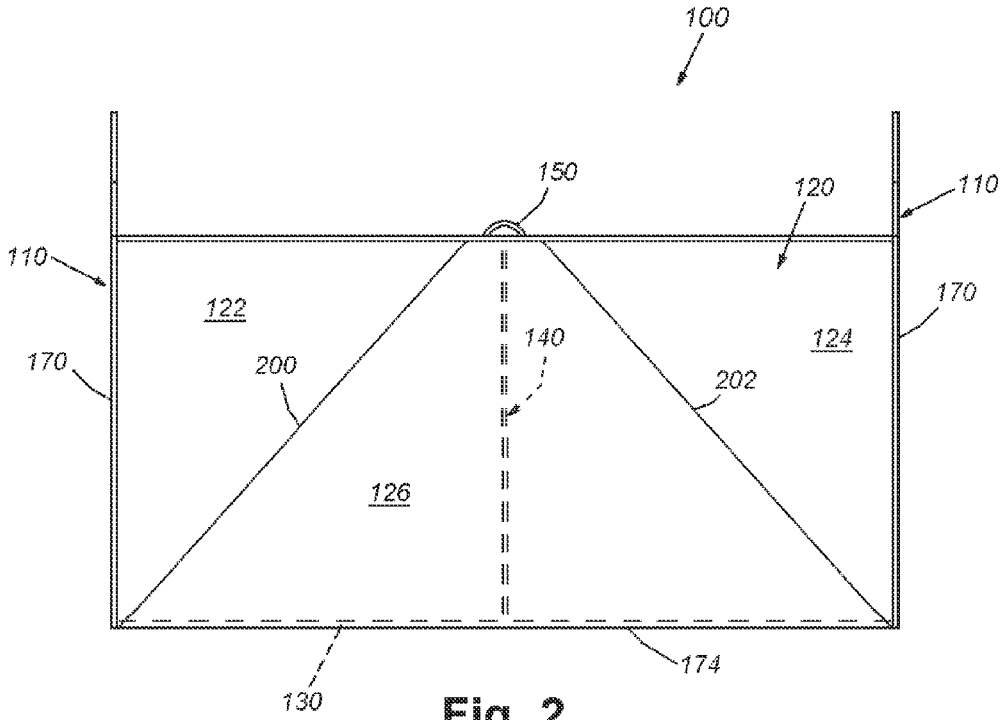
FIG. 2 is a side view of the collapsible cargo tote in the erect configuration according to the illustrative embodiment.

FIG. 2 depicts a side view of the tote 100 to elucidate the disposition of triangular side panels 122, 124, 126. Bottom seam 174 defines the long side of panel 126. Seam 200 defines the hypotenuse of panel 122 and a leg of panel 126. Likewise, seam 202 defines the hypotenuse of panel 124 and a leg of panel 126. The three side panels 122, 124, 126 create a foldable unitary side wall.

Figure 3:
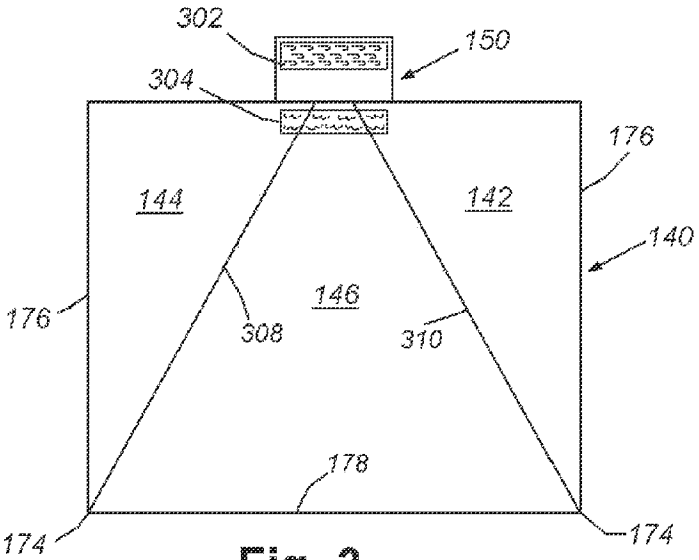
FIG. 3 is a view of a center wall of the collapsible cargo tote in the erect configuration according to the illustrative embodiment.

FIG. 3 shows the illustrative center wall 140 of the collapsible tote 100. The center wall 140 is comprised of panels 142, 144, 146. The locking cuff 150 is open, showing a hook and loop fastener system that is provided with a strip of hooks 302 and a fuzzy segment 304 for engaging the hooks. The fuzzy strip 304 extends across portions of each of the panels 142, 144, 146 such that when the locking cuff 150 is closed and the hooks of the hook strip 302 are engaged with the fuzzy strip 304, the panels are stationary relative to one another and are locked in place. In another embodiment, hook segments engage with other counterposed hook segments. Thus, locking the cuff 150 creates a removable lock on the center wall 140 and this in turn maintains the tote 100 in the erect configuration. The locking cuff 150 can be locked by manipulating the hook strip 302 onto the fuzzy strip 304 and unlocked by pulling the hook strip 302 away from the fuzzy strip 304. Seam 308 defines the connection of panel 144 with panel 146. Seam 310 defines the connection of panel 146 with panel 142. In a further embodiment, magnets and/or snaps are employable instead of the hook and loop fastener system.

Figure 4:
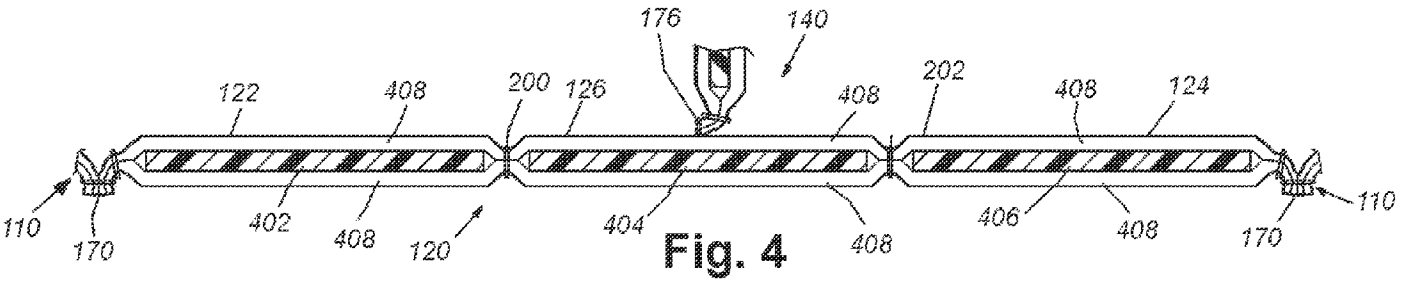
FIG. 4 is a cross section view of the front side wall along lines 4-4 of FIG. 1 the collapsible cargo tote in the erect configuration according to the illustrative embodiment.

FIG. 4 shows the internal structure of a sidewall 120. The illustrative sidewall shows three panels 122, 124, 126, the side seams 170, portions of the end walls 110 and a portion of the center wall 140. The wall structure is a sandwich of outer layers 408 of material and internal layers 402, 404, 406 of stiffener material. The outer layer is the exterior surface of the wall and is comprised of a nylon fabric or of another synthetic or natural fabric (for example, canvas). The stiffener material in layers 402, 404 and 406 can be a cardboard, rigid polymer or other like material that provides rigidity. In other embodiments, a lightweight metallic alloy and/or composite material can be used for the stiffener material. The stiffener material maintains the rigidity of the enclosing panel such that when the collapsible cargo tote 100 is in its erect configuration, the structural integrity of the erect structure around the enclosed volume is maintained. The center wall 140 is constructed and arranged similar to the side walls and each panel has a discrete stiffener layer. The bottom 130 can be provided with a unitary stiffener layer that extends to the perimeter seams 172, 174. The end walls 110 likewise are provided with unitary stiffener layers that extend to the perimeter seams 170, 172 and the handle cutout 118.

Figure 5:
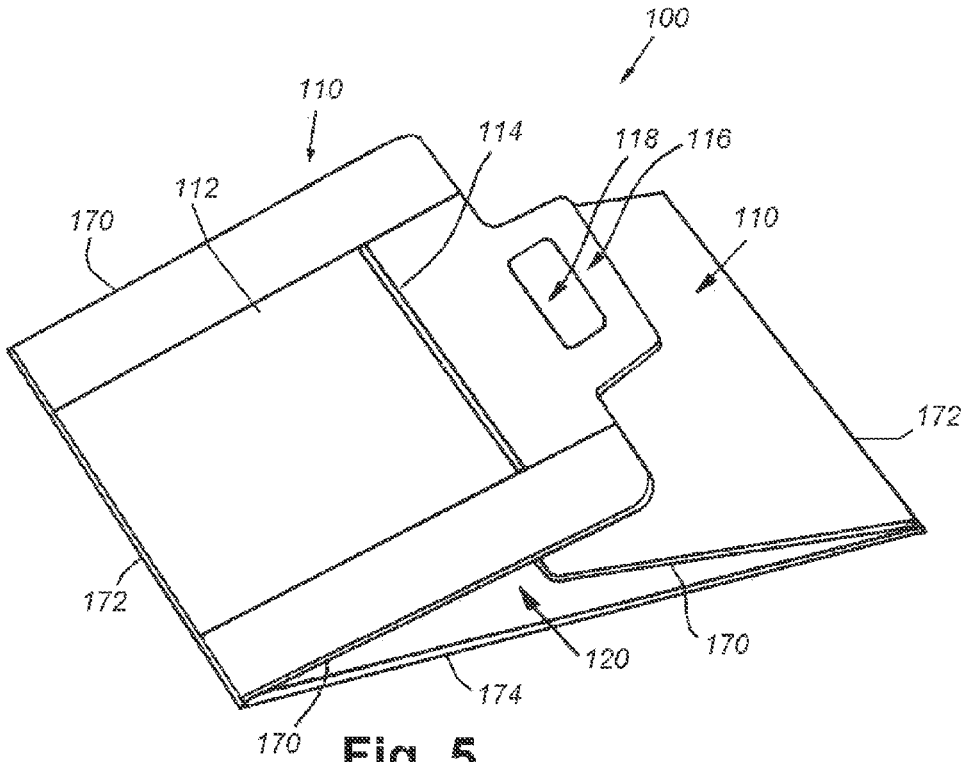
FIG. 5 is a perspective view of the collapsible cargo tote in a collapsed configuration according to the illustrative embodiment.

Tote 100 is shown in FIG. 5 in its collapsed configuration. In an embodiment, the tote 100 is depicted as being provided with a single pocket 112 that is on one end wall 110. In other embodiments, a pocket 112 can be provided on both end walls. It is further contemplated that more than one pocket can be provided on each end wall 110. In the collapsed configuration, a first end wall rests upon a second end wall and the second end wall rests upon the collapsed sidewalls and center wall. The tote does not have an enclosed volume in this configuration and the overall profile is flattened.

Figure 6:
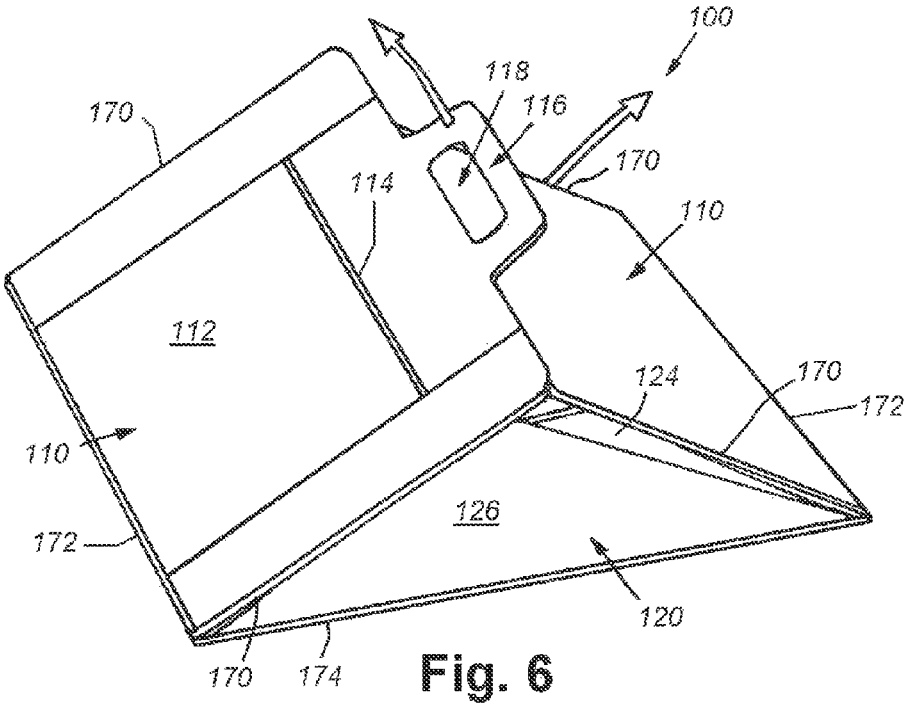
FIG. 6 is a view of the collapsible cargo tote in transition from a collapsed configuration to an erect configuration according to the illustrative embodiment.
Figure 7:
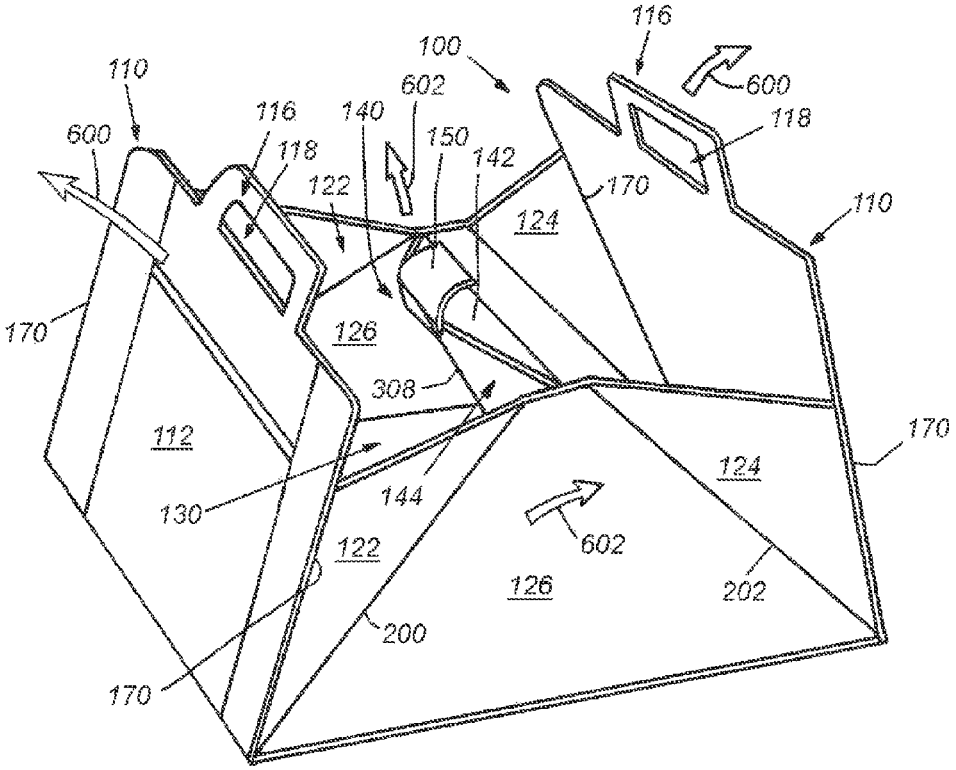
FIG. 7 is a view of the collapsible cargo tote in transition from a collapsed configuration to an erect configuration according to the illustrative embodiment.
Figure 8:
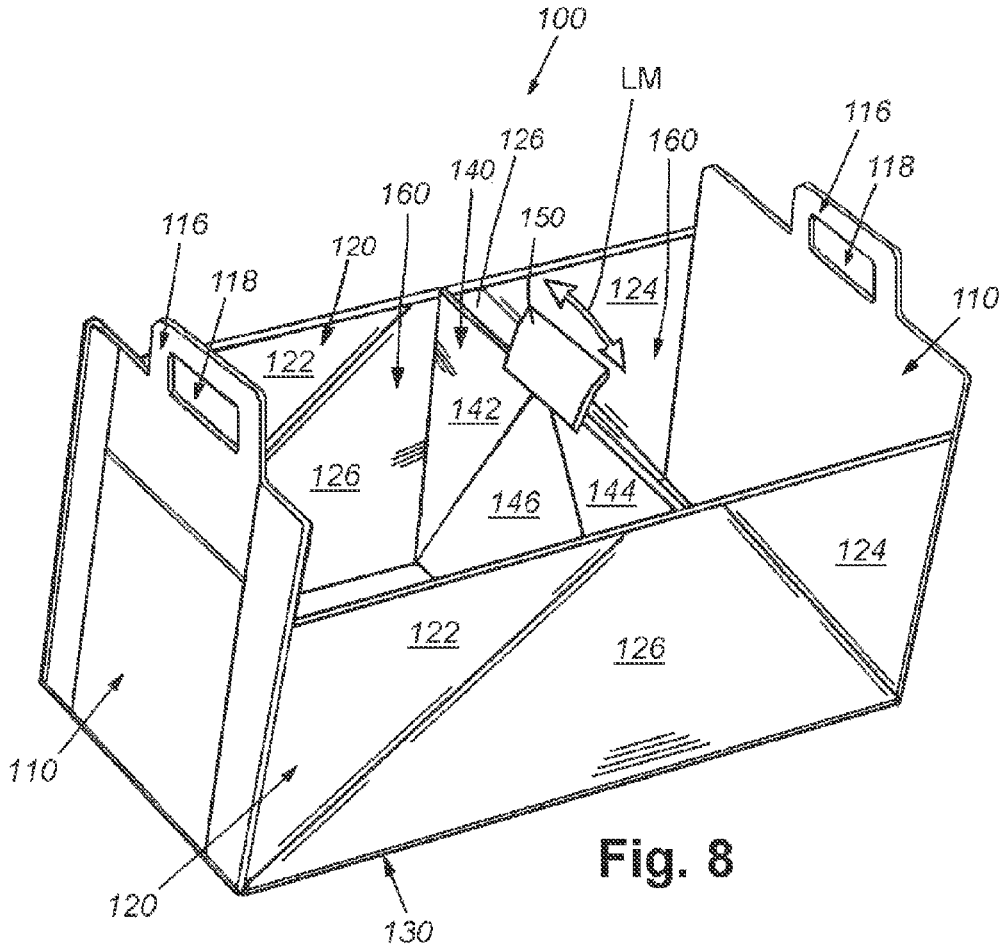
FIG. 8 is a view of the collapsible cargo tote in transition from an erect configuration to a collapsed configuration according to the illustrative embodiment.

The transition of the tote 100 from a collapsed configuration to an erect configuration is shown in FIGS. 6-8. With reference to FIG. 6, the tote 100 is shown partially raised. The operator grasps one or both of the handles 116 and raises the handle. This movement raises the topmost end wall 110 and exerts a pulling force on seams 170. The pulling force on seams 170 is then translated to the sidewalls 120, exerting a pull on panels 122, 124 and 126. Panels 122 and 124 are folded back onto panel 126 when the tote is in the collapsed configuration. The pulling force on seams 170 causes panels 122 and 124 to begin to unfold, which in turn begins to raise panels 126 on both sidewalls 120. This pulling force is in turn transferred to the next end wall 110 that is raised by the movement of the sidewalls and urged to a vertical orientation.

In FIG. 7, an upward pulling motion 600 continues to be exerted on the end walls 110. As noted above this motion is transmitted to the sidewalls 120 at the side seams 170. A corresponding upward movement 602 is transmitted to panel 126 via seams 200, 202. Movement 602 is in turn translated to the center wall 140, raising it from the bottom 130. This movement is the result of panels 126 rising so as to exert a pull on the center wall 140. As the sidewalls 120 approach a vertical orientation, the center wall 140 also approaches the vertical orientation. When the end walls 110, sidewalls 120 and center wall 140 are in the vertical orientation, the tote 100 is in an erect configuration. Locking the locking cuff 150 as described above in FIG. 3 locks the tote in the erect configuration.

FIG. 8 depicts the cargo tote 100 in an erect configuration. The locking cuff 150 moves through a motion LM to lock and unlock the tote. The locking force is exerted by the engagement of the hook and loop closure segments 302, 304 so as to span seams 308, 310 and secure panels 142, 144 and 146 in an engaged vertical state. The sustainment of center wall 140 in turn locks the sidewalls 120 and that in turn hold the end walls 110 upright. When the locking cuff 150 is unlocked by pulling upwards to disengage hook and loop closure segments 302, 304, panels 142, 144 and 146 are unlocked and begin falling downward towards the bottom 130, collapsing the center wall 140. The downward collapse of the center wall 140 pulls the connected side walls 120. The collapse of the tote as described is the transition from the erect configuration to the collapsed configuration.

Figure 9:
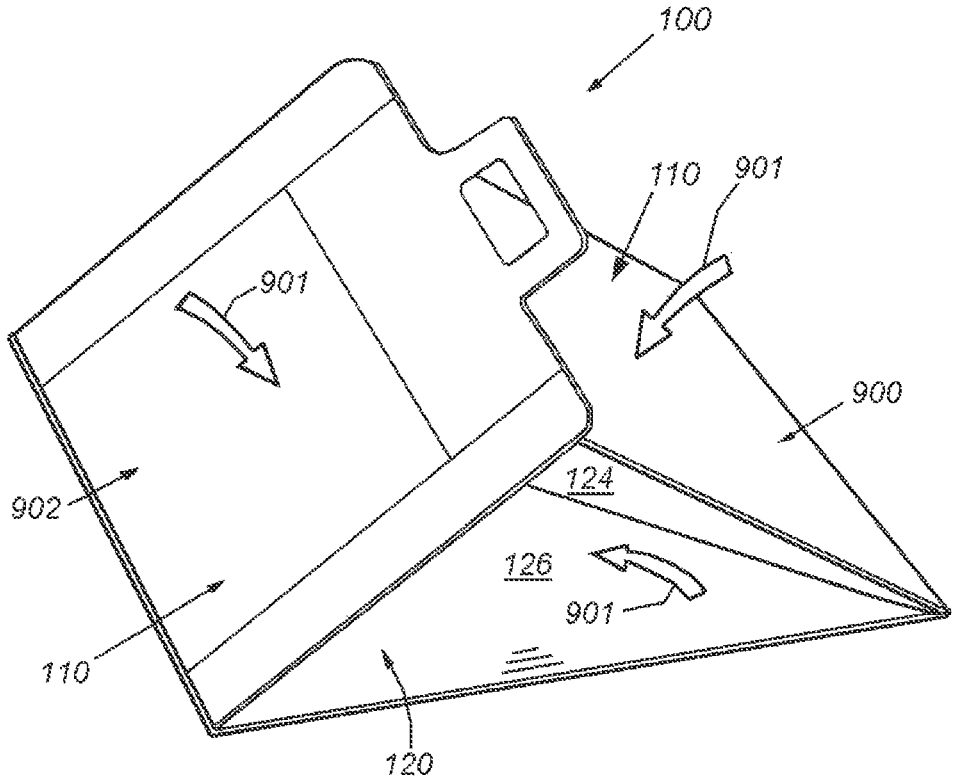
FIG. 9 is a view of the collapsible cargo tote in a collapsed configuration according to the illustrative embodiment.

FIG. 9 depicts the final stage of the transition of the cargo tote 100 from the erect configuration to the collapsed configuration. As noted above, the locking cuff was unlocked, causing the collapse of the center wall. This in turn collapses the sidewalls 120 and the end walls 110. End wall 900 is pulled by the collapsing sidewalls 120 downwards 901 ahead of end wall 902. End wall 902 becomes the topmost end wall when the cargo tote is fully collapsed. The end walls 110 have sufficient weight of material, including coverings and stiffener panels, to pull the entirety of the tote structure of sidewalls and endwalls into a collapsed state without further exertion.

It should be clear that the above described collapsible cargo tote provides a readily erected and collapsed cargo tote. The cargo tote in its erect configuration is rigid and creates two adjoined internal cargo bins 160. The cargo tote can be provided with a watertight insulated interior lining and become a collapsible open cooler. The handles of the tote provide for mobility when in an erect configuration. The locking cuff maintains the tote in the erect configuration and the unlocking of the locking cuff causes the tote to collapse into a collapsed configuration without additional force being applied.

More generally, as used herein the directional terms, such as, but not limited to, "up" and "down", "upward" and "downward", "top" and "bottom", "inside" and "outer", "front" and "back", "inner" and "outer", "interior" and "exterior", "horizontal" and "vertical" should be taken as relative conventions only, rather than absolute indications of orientation or direction with respect to a direction of the force of gravity.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. For example, the tote can be provided with a removable lid for use when the tote is in its erect configuration. The locking cuff can be provided with integral magnets that engage magnet-sensitive portions of the respective panels of the center wall and maintain the lock with magnet force. The locking cuff can be provided with a snapping closure system, with at least one snap that engages at least one of the panels of the center wall. The exterior pocket can be constructed with a flexible mesh pocket. Pockets can be provided on the sidewalls. The provided external pockets can have flap closures. At least one of the cargo bins can be constructed with a plurality of collapsible dividers that become vertically deployed when ion the erect configuration to serve as dividers for bottles that can be placed into the cargo bin. The addition of crushed and/or cubed ice into the bin can create an open cooler for beverages, including wines, beers and soft drinks. Accordingly, this description is meant to be taken only by way of example, and not to otherwise limit the scope of this invention.

What is claimed is:

1. A collapsible cargo tote comprising:

a bottom with an stiffener plate and an exterior surface covering;

at least one end wall with a stiffener plate and an exterior surface covering hingedly attached to the bottom;

at least one sidewall comprised of three connected panels, each of the three panels having a stiffener panel and an exterior surface covering hingedly attached to each other including diagonal seam lines that are hingedly attached to the end wall, and the bottom;

a center wall comprised of three connected panels, each of the panels having a stiffener panel and an exterior surface covering hingedly attached to each other including diagonal seam lines that are hingedly attached to the sidewall and the bottom;

a locking cuff configured to engage a portion of the center wall in an erect state;

wherein the sidewall, the end wall, and center wall are configured in the erect state when the locking cuff is engaged with the center wall, and wherein the sidewall, end wall and center wall are configured to collapse from an erect state into a collapsed configuration when the locking cuff is disengaged from the center wall.

2. The collapsible cargo tote of claim 1 wherein the locking cuff holds the tote in an erect configuration by the engagement of the locking cuff with each of the panels of the center wall.

3. The collapsible cargo tote of claim 1 wherein at least one of the end walls includes a handle that defines a cutout for receiving a hand and/or finger of a user.

4. The collapsible cargo tote of claim 1 wherein the locking cuff is provided with a hook and loop closure mechanism.

5. The collapsible cargo tote of claim 1 wherein at least one of the end walls is provided with an exterior pocket.

6. The collapsible cargo tote of claim 1 wherein at least one cargo bin is formed by the sidewalls and at least one of the end walls of the tote when in the erect configuration.

7. The collapsible cargo tote of claim 1 wherein the sidewalls and at least one of the end walls defines an interior volume for the containment of at least one item of goods when in the erect configuration.

* * * * *